US011845579B2

(12) United States Patent
Thaler et al.

(10) Patent No.: US 11,845,579 B2
(45) Date of Patent: Dec. 19, 2023

(54) SEALING APPARATUS AND METHOD FOR SEALING PACKAGES

(71) Applicant: Harro Hoefliger Verpackungsmaschinen GmbH, Allmersbach im Tal (DE)

(72) Inventors: Andreas Thaler, Allmersbach im Tal (DE); Daniel Birkhold, Allmersbach im Tal (DE)

(73) Assignee: Harro Hoefliger Verpackungsmaschinen GmbH, Allmersbach im Tal (DE)

( * ) Notice: Subject to any disclaimer, the term of this patent is extended or adjusted under 35 U.S.C. 154(b) by 36 days.

(21) Appl. No.: 17/837,873

(22) Filed: Jun. 10, 2022

(65) Prior Publication Data

US 2022/0396384 A1 Dec. 15, 2022

(30) Foreign Application Priority Data

Jun. 11, 2021 (EP) ..... 21179145.4

(51) Int. Cl.
*B65B 51/16* (2006.01)
*B65B 7/02* (2006.01)
(Continued)

(52) U.S. Cl.
CPC ..... *B65B 51/16* (2013.01); *B65B 7/02* (2013.01); *B65B 9/042* (2013.01); *B65B 51/023* (2013.01); *B65B 51/026* (2013.01)

(58) Field of Classification Search
CPC ..... B65B 51/16; B65B 7/02; B65B 9/042; B65B 51/023; B65B 51/026; B65B 47/04; B65B 7/164; B65B 11/50; B65B 51/10
See application file for complete search history.

(56) References Cited

U.S. PATENT DOCUMENTS

2007/0119542 A1* 5/2007 Williams ..... B65C 9/2221 156/556
2009/0133831 A1* 5/2009 Rehkugler ..... B65C 9/2221 29/401.1
(Continued)

FOREIGN PATENT DOCUMENTS

CN 105416638 A 3/2016
EP 3323740 A1 5/2018
(Continued)

*Primary Examiner* — Thomas M Wittenschlaeger
*Assistant Examiner* — Katie L Gerth
(74) *Attorney, Agent, or Firm* — Walter Ottesen, P.A.

(57) ABSTRACT

An apparatus and a method are for sealing packages on a flatbed machine. The package is formed from a base-film web and a water-soluble cover-film web. The sealing apparatus includes a liquid supply, at least one moistening unit, and a pressing device for vertically pressing and sealing the cover-film web together with the base-film web. The moistening unit has a moistening roller and a spraying device, the moistening unit being able to be switched between a first operating state and a second operating state. In the first operating state, the moistening roller acts on the cover-film web at a roller moistening location. During or after a machine standstill period, the sealing apparatus is transferred to a second operating state in which the spraying device acts on a spray portion of the cover-film web. The spray portion lies between the roller moistening location and the sealing location in the feed region.

10 Claims, 2 Drawing Sheets

(51) Int. Cl.
*B65B 9/04* (2006.01)
*B65B 51/02* (2006.01)

(56) References Cited

U.S. PATENT DOCUMENTS

| | | | | |
|---|---|---|---|---|
| 2012/0235329 | A1* | 9/2012 | Fowler | B65B 47/10 425/388 |
| 2015/0336691 | A1* | 11/2015 | Fowler | B65D 65/46 53/553 |
| 2016/0114914 | A1* | 4/2016 | Kepinski | B65B 1/02 53/436 |
| 2017/0088298 | A1* | 3/2017 | McLenithan | B65B 47/02 |
| 2017/0095586 | A1* | 4/2017 | Loebertmann | B65B 41/10 |
| 2017/0101203 | A1* | 4/2017 | Waterman | B65B 9/042 |
| 2017/0101204 | A1* | 4/2017 | Waterman | B65B 47/02 |
| 2018/0133919 | A1* | 5/2018 | Waterman | B65B 61/08 |
| 2018/0134431 | A1* | 5/2018 | Thienst | B65B 55/04 |
| 2018/0362193 | A1* | 12/2018 | Howell, II | B65B 39/007 |
| 2023/0109121 | A1* | 4/2023 | Brandt Sanz | B29C 65/522 510/445 |
| 2023/0182340 | A1* | 6/2023 | Waterman | B65B 61/08 83/13 |

FOREIGN PATENT DOCUMENTS

| | | | |
|---|---|---|---|
| GB | 2475538 | A | 5/2011 |
| WO | 2020/031096 | A1 | 2/2020 |

* cited by examiner

SEALING APPARATUS AND METHOD FOR SEALING PACKAGES

CROSS REFERENCE TO RELATED APPLICATION

This application claims priority of European patent application no. 21179145.4, filed Jun. 11, 2021, the entire content of which is incorporated herein by reference.

TECHNICAL FIELD

The disclosure relates to a sealing apparatus for sealing packages, and also to a method for operating such a sealing apparatus.

BACKGROUND

Washing or dishwashing agents for household use are increasingly packaged in the form of powders or liquids in water-soluble packages. The packages are made of a water-soluble film and contain a filling of one unit dose of the washing or dishwashing agent. The filled and sealed package unit is placed into the washing machine or dishwasher. Upon contact with water, the film package dissolves and releases the content in the provided quantity.

In the production of such a package unit, a base film and a cover film are used, which are formed from water-soluble films. Normally, the base film is thermoformed into corresponding dies under the action of heat and vacuum. As a result of the forming process, depressions form in the base film, which are filled with the filling. A cover film is subsequently sealed onto the base film. Via the sealing of the two films, the filling situated in the molds is enclosed.

Finally, the sealed package units are cut out of the coherent film webs, such that the package units can be used individually by the user.

For the sealing of such packages, use is made not only of the hot-sealing method such as is known per se for films but also of a water-based sealing. On drum-type machines, in which the dies are arranged on revolving drums, use is made of moistening units with a felt roller, via which water is applied to the cover film. The moistened felt roller rolls on the water-soluble film web, as a result of which the surface of the film web is dissolved. The cover film with dissolved surface is then pressed onto the prepared base film via a pressing device, the dissolution of the film surface giving rise to a sealing action. An arrangement and method of this type are known, for example, from GB 2 475 538 A. Owing to the cylindrical drum shape, the filling and the sealing have to be effected in direct succession and in close proximity to the upper vertex of the drum so that the product filled therein remains in the thermoformed depression and does not escape. This restricts the capacity of such a machine type.

As an alternative to the drum-type machines mentioned, use is made of flatbed machines in which format plates with dies formed therein are moved in a circulating manner similar to a conveyor belt and thus perform a horizontal movement during the relevant process steps for the thermoforming, filling and sealing. In this way, greater output quantities per unit time are possible compared with drum-type machines, since one or more format plates with in each case multiple dies can carry out a process step at the same time. However, the latter requires that the individual process stations be locally relatively far apart from one another along the horizontal movement path.

In the event of an interruption in production, that is, a temporary machine standstill period, this distance is notable in a disadvantageous manner. Between the moistening device and the sealing location, there is a relatively long portion of the moistened cover-film web that has not yet been sealed on and that starts to dry during the standstill period. During the restart operation after the machine standstill period, this film portion no longer has the desired degree of moisture and can no longer be readily sealed on in the required quality. Improperly closed products from which the filling material escapes and soils the packaging machine are produced, which may lead to a further machine standstill period. In addition, the improperly closed products may not be discharged properly at the machine outlet.

Re-moistening of the critical, incipiently dried film portion is not possible with the moistening roller. As an alternative thereto, US 2018/0134431 describes an apparatus and a method, in which use is made of an electromechanical spraying system with a row of outlet nozzles for contactlessly spraying a water-containing liquid onto the cover-film web, similar to an inkjet printer. During normal operation, the electromechanical spraying system moistens the cover-film web on the circumference of the pressing roller, that is, just before the sealing location. Nevertheless, between the moistening location and the sealing location, there is a certain film portion which may start to dry in the event of a machine standstill period and which may lead to the above-described consequences during the subsequent restart operation. In order to counter this, US 2018/0134431 also describes the possibility of a pivotable configuration of the electromechanical spraying system, which is intended to be used during the restart operation. However, pivoting for the re-moistening means that the row of spraying nozzles have to be pivoted from the original moistening location and directed onto the incipiently dried lower region of the pressing roller, as a consequence of which not only the cover-film web but also the thermoformed base-film web with the product already filled therein is likewise moistened in an undesired manner. Complex countermeasures are required. The problem of the restart operation is not satisfactorily solved in US 2018/0134431.

SUMMARY

It is an object of the disclosure to provide a sealing apparatus with improved restart behavior.

This object can, for example, be achieved via a sealing apparatus for sealing packages on a flatbed machine, the packages being formed from a base-film web and a cover-film web, at least the cover-film web being formed from a water-soluble film. The sealing apparatus includes: a liquid supply for a water-containing liquid; at least one moistening unit configured to wet the cover-film web with the water-containing liquid; a pressing device for vertically pressing and sealing the cover-film web together with the base-film web at a sealing location in a state in which the cover-film web is wetted with the water-containing liquid; the sealing apparatus having a feed region in which the cover-film web is fed from top to bottom to the pressing device; the moistening unit being configured to act on the cover-film web in the feed region; the moistening unit having a moistening roller and a spraying device for the water-containing liquid; the moistening unit being configured to be switched between a first operating state and a second operating state; the moistening roller being configured to act on the cover-film web at a roller moistening location in the first operating state; and, the spraying device being configured, in the second operating state, to act on a spray portion of the cover-film web in the feed region, the spray portion lying between the roller moistening location and the sealing location.

It is a further object of the disclosure to provide a method for operating such a sealing apparatus, the method avoiding the formation of defective packages during the restart operation after a machine standstill period.

This object can, for example, be achieved via a method including: wetting the cover-film web with water-containing liquid in the feed region at the roller moistening location via the moistening roller in the first operating state; guiding the cover-film web to the base film web running horizontally on the flatbed machine in the first operating state; vertically pressing and sealing together the cover-film web and the base-film web at the sealing location via the pressing device in the first operating state; switching the sealing apparatus to the second state during or after a machine standstill period; wetting a spray portion of the cover-film web with the water-containing liquid via the spraying device during a restart operation, wherein the spray portion of the cover-film web lies in the feed region between the roller moistening location and the sealing location; transferring the sealing apparatus back to the first operating state and the wetting via the moistening roller being performed again; guiding the cover-film web by way of the wetted spray portion to the base-film web running horizontally on the flatbed machine; and, vertically pressing and sealing the cover-film web together with the base-film web along the spray portion at the sealing location via the pressing device.

Provision is made according to the disclosure for the moistening unit to have a moistening roller and a spraying device for the water-containing liquid, the moistening unit being able to be switched between a first operating state and a second operating state. In the first operating state, the moistening roller acts on the cover-film web at a roller moistening location. In the second operating state, the spraying device acts on a spray portion of the cover-film web, the spray portion lying between the roller moistening location and the sealing location, in the feed region.

According to the associated method according to the disclosure, in the first operating state, the cover-film web is wetted with the water-containing liquid in the feed region at a roller moistening location via the moistening roller, is guided to the base film running horizontally on the flatbed machine and is vertically pressed and sealed together with the base film at the sealing location via the pressing device.

During or after a machine standstill period, the sealing apparatus is transferred to a second operating state. During the restart operation, in the second operating state, the spray portion of the cover-film web, the spray portion lying in the feed region between the roller moistening location and the sealing location, is wetted with the water-containing liquid via the spraying device. Subsequently, the sealing apparatus is transferred back to the first operating state and the wetting via the moistening roller is incorporated again. The cover-film web is guided by way of its wetted spray portion to the base film running horizontally on the flatbed machine and is vertically pressed and sealed together with the base film, along the spray portion, at the sealing location via the pressing device.

Accordingly, a basic idea includes using the proven moistening roller known per se from drum-type machines in a flatbed machine, and thus accepting the relatively large spacing between the roller moistening location and the sealing location, during normal operation. In this way, it is possible to ensure reliable and uniform moistening of the upper cover-film web with simple means during normal operation. The problems in the case of the temporary machine standstill period and in the case of the subsequent restart operation of the machine that are described in the introduction are solved through the use of the spraying device. During the restart operation and just before the transition to normal operation, the incipiently dried film region is at least approximately completely re-moistened and thus brought into a sealing-capable state. This re-moistening is effected in the feed region in which the cover-film web is fed from top to bottom to the pressing device. In this way, only the cover film is moistened, but not the thermoformed base-film web with the product already filled therein. The latter remains dry and is therefore not damaged. The re-moistened region can then be sealed on properly, and so tightly closed package units are produced. Escape of the filling and soiling of the machine are reliably avoided. The sealed units can then pass through all the subsequent processing stations in a proper manner and be removed in the form of finished, separated package units. These package units sealed with the re-moistened cover-film web may not meet the imposed quality requirements, such that they have to be rejected as faulty parts. But at least they do not hinder the resumed proper operation, such that the latter can take place in an unobstructed manner.

For unobstructed resumption of operation, it may possibly suffice for only a subregion of the incipiently dried film portion to be re-moistened. In a refinement of the disclosure, however, the spray portion extends at least approximately from the roller moistening location as far as the sealing location. This makes it possible for the incipiently dried film portion to be completely re-wetted with moisture and to subsequently be sealed on completely in a proper manner, without the occurrence of gaps in the moistening and thus gaps in the sealing quality.

In an embodiment, the spraying device has a spraying nozzle for dispensing the water-containing liquid in a jet fan and is configured to cover the entire spray portion via the jet fan. The width of the jet fan is used to achieve a situation in which re-moistening of the entire spray portion is completed in only a single operation. The short period of time required for this contributes to the homogeneity of the moisture level achieved, to a rapid resumption of normal operation and to a seamless transition of the re-moistened film portion to the normally moistened cover-film web.

It may be expedient for multiple such nozzles to be arranged next to one another in a row and thus to cover the width of the cover-film web. However, in a refinement, the spraying device includes an individual spraying nozzle which is mounted on a slide and which can be moved transversely with respect to the cover-film web via the slide. In conjunction with uniform conveyance of water, this makes it possible to achieve uniform wetting with minimal outlay.

Various types of construction are suitable for the configuration of the spraying device. By way of example, a nozzle with intermittent piezo-delivery may be provided, in order to generate a pulsing spray pattern. However, preferably, the spraying nozzle can be supplied with the water-containing liquid from a pressure source and is configured to continuously dispense the water-containing liquid. In this way, a homogeneous water film can be generated using customary and cost-effective assemblies.

In an embodiment, the feed region is configured to, in the second operating state, guide the cover-film web at an angle of 70° to 110°, and in particular at an angle of 80° to 100°, with respect to the horizontal, that is, at least approximately vertically, at least along the larger part of the spray portion. In this way, the plane of the cover-film web in its spray portion lies at least approximately orthogonally with respect to the plane of the horizontally guided base-film web. Consequently, the spraying direction is, on the one hand, approximately perpendicular to the spray portion, which ensures effective wetting, and is, on the other hand, approximately parallel to the base film, as a result of which the latter experiences practically no unintentional moistening whatsoever.

In a refinement, the pressing device is positioned at the sealing location in the first operating state and is removed therefrom in the second operating state. In this case, the sealing apparatus has a stretching apparatus which acts on the cover-film web in the spray portion in the second operating state. After the pressing device has been removed, the stretching apparatus can be used to bring the cover-film web, proceeding from the sealing location, completely into the upright position and to hold it there stretched in a planar state. This permits exact re-moistening as far as directly at the sealing location, without adversely affecting the lower base-film web. Consequently, the sealing operation can be continued in a seamless manner.

The moistening roller can preferably be lifted off from the cover-film web in the second operating state. This contributes to the re-moistening being able to be carried out directly as far as the roller moistening location, without the moistening roller being in the way. After the moistening roller has been reapplied, a film surface which is moistened in a seamlessly continuous manner is produced.

BRIEF DESCRIPTION OF THE DRAWINGS

The invention will now be described with reference to the drawings wherein:

FIG. 1 shows a lateral view of a sealing apparatus according to the disclosure during normal operation in a flatbed packaging machine with a moistening roller for moistening the cover-film web to be sealed on;

DESCRIPTION OF THE PREFERRED EMBODIMENTS

Figure 1:
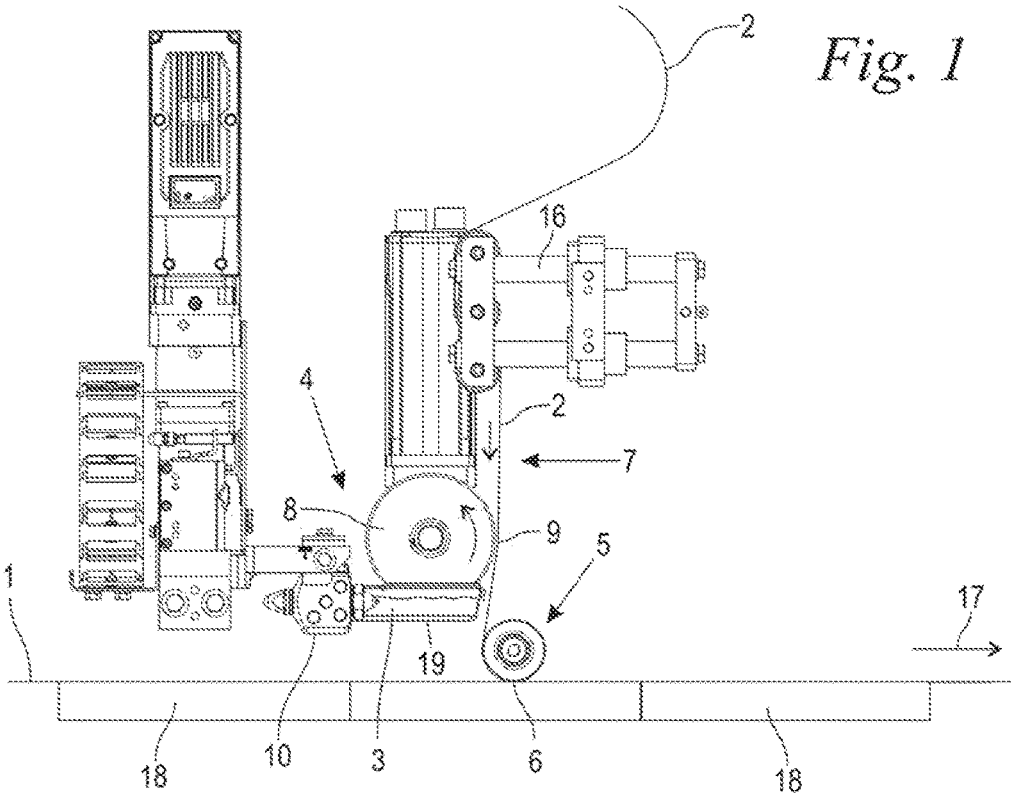

FIG. 1 shows a lateral view of a detail of a flatbed packaging machine for producing package units from a thermoformed base-film web 1 and a cover-film web 2 which is sealed onto the base-film web 1. At least the cover-film web 2, and also the base-film web 1 in this case, is made of a water-soluble film, for which PVOH (polyvinyl alcohol) can preferably be selected. The package units are filled with dishwashing agent, washing agent or the like.

The packaging machine has a plurality of processing stations, but for the sake of simplicity, FIG. 1 shows only a detail in the region of the sealing station thereof with the sealing apparatus according to the disclosure. This is preceded by a thermoforming station (not illustrated) and a filling station. The sealing apparatus shown is also followed by a separation station and a removal station.

A plurality of format plates 18 with in each case multiple dies (not illustrated here) formed therein are conveyed, in accordance with an arrow 17, in the manner of a conveyor belt in a rectilinear, horizontal and in this case also continuous manner through the individual processing stations and then returned in a circulating manner. However, intermittent operation may also be expedient. In the thermoforming station, the base-film web 1 which rests flatly and horizontally on the format plates 18 is heated to a temperature of plastic deformability and is thermoformed via vacuum into the dies of the format plates 18 and held there. This produces depressions or cavities which are thermoformed in the base-film web 1 and which are filled with the filling material, that is, with the dishwashing or washing agent, in the subsequent filling station. Subsequently, in the sealing station shown here, the sealing device according to the disclosure is used to apply a cover-film web 2 to the base-film web prepared in this way and to seal the cover-film web onto the base-film web, as a consequence of which a multi-layer web with individual filled, tightly closed film cavities is produced. These are cut out in the form of package units in the separation station already mentioned in the introduction, and finally removed from the format plates 18 in the removal station for further use.

As per FIG. 1, the sealing apparatus according to the disclosure has a moistening unit 4 for wetting the cover-film web 2 with the water-containing liquid 3. In this case, the water-containing liquid provided is water with added surfactants. However, mains water may also be expedient. The moistening unit 4 includes a moistening roller 8 and a spraying device 10, which are both configured, and provided, for applying the water-containing liquid 3 to the cover-film web 2. The sealing apparatus according to the disclosure furthermore has a pressing device 5, which is configured, and provided, for vertically pressing and sealing the cover-film web 2, which is moistened via the moistening unit 4, together with the base-film web 1 at a sealing location 6. In the embodiment shown, the pressing device 5 is embodied as a laminating roller, which linearly rests, with the interposition of the packet made of base-film and cover-film web 1, 2, with vertical pressure on the format plates at the sealing location 6. However, it is also possible to use pressure rams or the like. Under the action of the pressure mentioned, the previously moistened cover-film web 2, which has thus started to dissolve at its surface, is sealed in a materially bonded manner onto the base-film web 1. Finally, it is also apparent that the sealing apparatus has a feed region 7 in which the cover-film web 2 is fed from top to bottom to the pressing device 5, that is, substantially transversely with respect to the conveying direction 17 of the format plates 18 with the base-film web 1. The moistening unit 4 acts on the cover-film web 2 in this feed region 7. In other words, the moistening of the cover-film web 2 is effected in the feed region 7, that is, where the cover-film web 2 is moved from top to bottom. A stretching apparatus 16 holds the cover-film web 2 in position within the feed region 7, and in the stretched state under longitudinal tension.

FIG. 1 shows the sealing apparatus according to the disclosure in a first operating state, in which a normal, continuous sealing operation is carried out. In this case, the spraying device 10 is passive. Rather, the moistening is performed solely via the moistening roller 8, which is embodied in this case as a felt roller and bears on the surface of the cover-film web 2 at a roller moistening location 9 in the feed region 7. The roller moistening location 9 may be linear. In the embodiment shown, the cover-film web 2 bears against the moistening roller 8 over a slight wrap angle, such that the roller moistening location 9 has the shape of a narrow, but areal strip. The moistening roller 8 projects from above partially into a water tray 19 filled with the liquid 3. There, it takes up the liquid 3 and dispenses it at the roller moistening location 9 onto the cover-film web 2 so as to be distributed over its entire width. To this end, it may suffice for the moistening roller 8 to simply roll on the surface of the cover-film web 2 without a dedicated drive. However, the moistening roller 8 can preferably have a dedicated drive, via which it rotates in the opposite direction to the drawing-off direction of the cover-film web 2.

During normal operation, the cover-film web 2 moistened in this way is then furthermore drawn off continuously, fed to the pressing device 5 and sealed on as described above. However, temporary interruptions in operation or machine standstill periods may occur, at the end of which, after the packaging machine has been restarted, the materials present therein are intended to be further processed in an unobstructed manner to form package units. Such interruptions, in which the continuous movement and further processing are absent, lead to undesired incipient drying of the already moistened but not yet sealed-on cover-film webs 2, which are at a standstill, in the region between the roller moistening location 9 and the sealing location 6.

Figure 2:
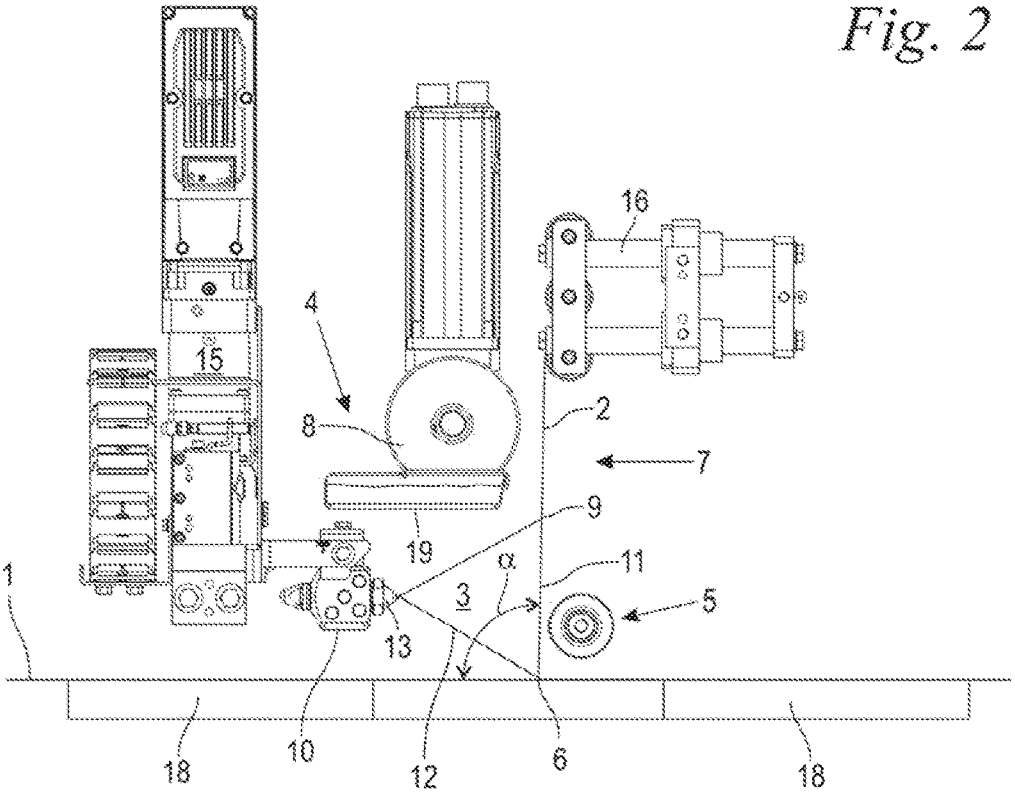
FIG. 2 shows the arrangement as per FIG. 1 after a machine standstill period and during the preparation of the restart of the machine with a spraying device for re-moistening the cover-film web; and, FIG. 3 shows a frontal view of the spraying device as per FIG. 2 with an individual spraying nozzle mounted on a transversely movable slide.

For the resumption of operation and for a required re-moistening of the incipiently dried film portion, according to the operating method according to the disclosure, the sealing apparatus is switched to a second operating state, which is illustrated in FIG. 2. The switching may be effected during the machine standstill period or immediately thereafter during the restart operation of the packaging machine. In any case, the sealing apparatus is thus transferred to a state in which the moistening roller is initially passive during the restart operation of the machine, and in which the already mentioned spraying device is used instead. In this case, the spraying device 10 acts on a spray portion 11 of the cover-film web 2, the spray portion lying between the roller moistening location 9 and the sealing location 6, in the feed region 7. In other words, in the second operating state, the spray portion 11 of the cover-film web 2, the spray portion lying in the feed region 7 between the roller moistening location 9 and the sealing location 6 and having previously already been wetted once and having then incipiently dried, is re-wetted with the water-containing liquid 3 via the spraying device 10.

Viewing FIGS. 1 and 2 together, further details to this end are apparent: the pressing device 5 is positioned at the sealing location 6 in the first operating state and removed therefrom in the second operating state. For this purpose, in the second operating state (FIG. 2), the laminating roller has been moved or pivoted, proceeding from the operating position of the first operating state (FIG. 1), upward to the right, as a result of which the sealing location 6 is no longer covered in the second operating state, but rather is freed in the upward direction. The cover-film web 2 is then held in position, and under longitudinal tension, in the entire feed region 7, and in particular in a spray portion 11 which is described in more detail below, via the stretching apparatus 16. In this case, "held in position" means that, in the second operating state, the cover-film web 2 is guided at an angle $\alpha$ of 70° to 110°, and preferably of 80° to 100°, with respect to the horizontal, at least along the larger part of the spray portion 11. In the embodiment shown, the stretching apparatus 16 has been moved to the right in relation to the operating position according to FIG. 1 to such an extent that it is positioned exactly above the sealing location 6 and, as a result, guides and holds the cover-film web 2 at an angle ($\alpha$) of approximately 90° with respect to the horizontal in the feed region 7, in particular in the spray portion 11. The repositioning of the pressing device 5 and of the stretching apparatus 16 also repositions the cover-film web 2 to the right in the feed region 7, that is, away from the moistening roller 8, as a consequence of which the cover-film web 2 and the moistening roller 8 are lifted off from one another. In addition, in the second operating state according to FIG. 2, the moistening roller, including its water tray 19, has also been raised in relation to the first, normal operating state according to FIG. 1 to such an extent that that portion of the cover-film web 2 between the previous roller moistening location 9 and the sealing location 6 is freed in a horizontal direction toward the spraying device 10.

In this state, during the restart operation of the packaging machine, the previously incipiently dried portion of the cover-film web 2 is re-wetted with the water-containing liquid 3, this re-wetting being carried out via the spraying device 10. That region of the cover-film web 2 which is reached by the spraying device 10 between the roller moistening location 9 and the sealing location 6 is in this case referred to as spray portion 11. It may possibly suffice for a spray portion 11 which does not completely cover the section between the roller moistening location 9 and the sealing location 6 to be wetted. However, as a result of the above-described measures and a corresponding configuration of the spraying device 10, the spray portion 11 according to the illustration as per FIG. 2 extends at least approximately, in this case even completely, from the roller moistening location 9 as far as the sealing location 6.

To this end, the spraying device 10 has a spraying nozzle 13 for dispensing the water-containing liquid 3 in a jet fan 12. The opening angle of the jet fan 12 and the spacing of the spraying nozzle 13 from the cover-film web 2 are matched to one another in such a way that the spray portion 11 is completely covered, in relation to the longitudinal direction of the second film web 2, via the jet fan 12.

Figure 3:
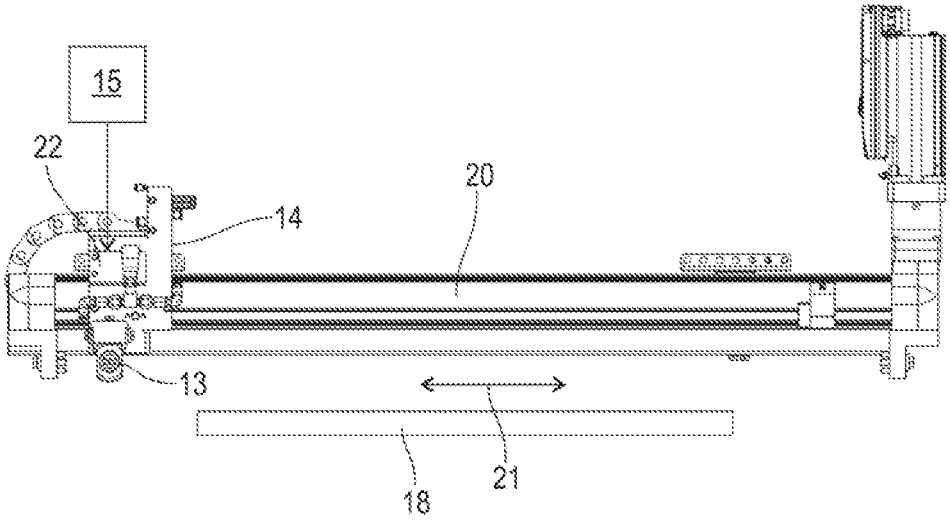

It is also possible for a plurality of such spraying nozzles to be arranged next to one another. This would open up the possibility of the spray portion 11 being moistened, along the entire width of the cover-film web 2, with a single spray burst via overlapping, conical jet fans 12. However, in the embodiment shown, only one individual spraying nozzle 13 is provided, additional details of which are illustrated in the frontal view according to FIG. 3. Accordingly, the spraying nozzle 13 is mounted, together with an associated control unit 22, on a slide/carriage 14 and can be moved, in accordance with a double-headed arrow 21, transversely with respect to the longitudinal direction of the cover-film web 2 on a guide rail 20 via this slide 14. The control unit 22 includes a needle valve (not illustrated) and is responsible for setting and maintaining a certain flow rate of the water-containing liquid 3 through the spraying nozzle 13. In addition, a pressure source 15 (indicated only schematically in this case) for the water-containing liquid 3 is also provided, from which the water-containing liquid 3 is supplied and fed, through the control unit 22, to the spraying nozzle 13. The pressure source 15 may be a pump, and is a pressure tank in the present case. However, other suitable pressure sources 15 may also be selected. The structural unit made of liquid pump 15 and spraying nozzle 13 is in particular configured, with the aid of the control unit 22, to continuously dispense liquid and thus to continuously generate the jet fan 12 in the form of an upright flat jet. The jet fan 12 is thus continuously running and moved in a continuous movement along the full width of the cover-film web 2, whereby the spray portion 11 is wetted over the entire width with the water-containing liquid 3.

After the incipiently dried spray portion 11 has been re-moistened, the sealing apparatus is transferred back to its first operating state as per FIG. 1, the spraying device 10 is taken out of operation, and the wetting of the cover-film web 2 via the moistening roller 8 is incorporated again. The restart operation of the packaging machine also involves the cover-film web 2 being guided by way of its wetted spray portion 11 to the base film 1 running horizontally on the flatbed machine and being vertically pressed and sealed in the above-described manner together with the base film, along the spray portion 11, at the sealing location 6 via the pressing device 5. However, as soon as the spray portion 11 has been completely sealed on and the cover-film web 2 which is moistened in the normal manner via the moistening roller 8 reaches the sealing location 6, the normal sealing operation sets in again, and the restart operation of the packaging machine can be considered completed.

Just like the package units which are moistened and sealed in the regular manner, the package units which are sealed during the restart operation via the spray portion 11 are tight. Depending on the profile of requirements, they may be used as a decent product or alternatively rejected. In any case, the tightness obtained is sufficient for proper operation of the packaging machine.

It is understood that the foregoing description is that of the preferred embodiments of the invention and that various changes and modifications may be made thereto without departing from the spirit and scope of the invention as defined in the appended claims.

What is claimed is:

1. A sealing apparatus for sealing packages on a flatbed machine, the packages being formed from a base-film web and a cover-film web, at least the cover-film web being formed from a water-soluble film, the sealing apparatus comprising:

a liquid supply for a water-containing liquid;

at least one moistening unit configured to wet the cover-film web with the water-containing liquid;

a pressing device for vertically pressing and sealing the cover-film web together with the base-film web at a sealing location in a state in which the cover-film web is wetted with the water-containing liquid;

the sealing apparatus having a feed region in which the cover-film web is fed from top to bottom to said pressing device;

said moistening unit being configured to act on the cover-film web in said feed region;

said moistening unit having a moistening roller and a spraying device for the water-containing liquid;

said moistening unit being configured to be switched between a first operating state and a second operating state;

said moistening roller being configured to act on the cover-film web at a roller moistening location in the first operating state; and, said spraying device being configured, in the second operating state, to act on a spray portion of the cover-film web in the feed region, said spray portion lying between the roller moistening location and the sealing location.

2. The sealing apparatus of claim 1, wherein the spray portion extends at least from the roller moistening location as far as the sealing location.

3. The sealing apparatus of claim 1, wherein said spraying device has a spraying nozzle configured to dispense the water-containing liquid in a jet fan and further configured to cover all of said spray portion via said jet fan.

4. The sealing apparatus of claim 3, wherein said spraying device includes a single spraying nozzle mounted on a slide; and, said single spraying nozzle is configured to be moved transversely with respect to the cover-film web via said slide.

5. The sealing apparatus of claim 3, wherein said spraying nozzle is supplied with the water-containing liquid from a pressure source and is configured to continuously dispense the water-containing liquid.

6. The sealing apparatus of claim 1, wherein said feed region is configured to, in the second operating state, guide the cover-film web at an angle ($\alpha$) of 70° to 110° with respect to a horizontal, at least along a larger part of said spray portion.

7. The sealing apparatus of claim 1, wherein said feed region is configured to, in the second operating state, guide the cover-film web at an angle ($\alpha$) of 80° to 100° with respect to a horizontal, at least along a larger part of the spray portion.

8. The sealing apparatus of claim 1 further comprising:

a stretching apparatus configured to act on the cover-film web in said spray portion in said second operating state; and, said pressing device being positioned at said sealing location in said first operating state and being removed from said sealing location in said second operating state.

9. The sealing apparatus of claim 1, wherein said moistening roller is lifted off from the cover-film web in said second operating state.

10. A method for operating a sealing apparatus for sealing packages on a flatbed machine, the packages being formed from a base-film web and a cover-film web, at least the cover-film web being formed from a water-soluble film, the sealing apparatus including a liquid supply for a water-containing liquid and at least one moistening unit configured to wet the cover-film web with the water-containing liquid; the sealing apparatus further including a pressing device; the sealing apparatus having a feed region in which the cover-film web is fed from top to bottom to the pressing device; the moistening unit being configured to act on the cover-film web in the feed region; the moistening unit having a moistening roller and a spraying device for the water-containing liquid; the moistening unit being configured to be switched between a first operating state and a second operating state; the moistening roller being configured to act on the cover-film web at a roller moistening location in the first operating state; and, the spraying device being configured, in the second operating state, to act on a spray portion of the cover-film web in the feed region, the spray portion lying between the roller moistening location and the sealing location, the method comprising:

wetting the cover-film web with water-containing liquid in the feed region at the roller moistening location via the moistening roller in the first operating state;

guiding the cover-film web to the base film web running horizontally on the flatbed machine in the first operating state;

vertically pressing and sealing together the cover-film web and the base-film web at the sealing location via the pressing device in the first operating state;

switching the sealing apparatus to the second state during or after a machine standstill period;

wetting a spray portion of the cover-film web with the water-containing liquid via the spraying device during a restart operation, wherein the spray portion of the cover-film web lies in the feed region between the roller moistening location and the sealing location;

transferring the sealing apparatus back to the first operating state and the wetting via the moistening roller being performed again;

guiding the cover-film web by way of the wetted spray portion to the base-film web running horizontally on the flatbed machine; and, vertically pressing and sealing the cover-film web together with the base-film web along the spray portion at the sealing location via the pressing device.

* * * * *